US009114909B2

(12) United States Patent
Wagner

(10) Patent No.: US 9,114,909 B2
(45) Date of Patent: Aug. 25, 2015

(54) STORAGE CONTAINER

(75) Inventor: Charles E. Wagner, Winfield, KS (US)

(73) Assignee: Western Industries, Inc., Winfield, KS (US)

( * ) Notice: Subject to any disclaimer, the term of this patent is extended or adjusted under 35 U.S.C. 154(b) by 1239 days.

(21) Appl. No.: 13/021,273

(22) Filed: Feb. 4, 2011

(65) Prior Publication Data

US 2012/0199513 A1 Aug. 9, 2012

(51) Int. Cl.

| | |
|---|---|
| ***B65D 43/14*** | (2006.01) |
| ***B65D 21/02*** | (2006.01) |
| ***B65D 43/16*** | (2006.01) |
| ***B65D 25/28*** | (2006.01) |
| ***B65D 45/20*** | (2006.01) |

(52) U.S. Cl.

CPC ..... *B65D 21/0233* (2013.01); *B65D 25/2897* (2013.01); *B65D 43/164* (2013.01); *B65D 43/166* (2013.01); *B65D 45/20* (2013.01); *B65D 43/165* (2013.01); *B65D 2251/1016* (2013.01); *Y10T 29/4998* (2015.01)

(58) Field of Classification Search

CPC ..... B65D 2251/1025; B65D 43/167; B65D 43/166

USPC ..... 16/221, 254, 260, 267, 268, 269, 270, 16/322, 355, 231, 382, 387, 388, 389, 16/DIG. 43; 220/324, 838, 843, 845, 847, 220/848, 810; 215/237

See application file for complete search history.

(56) References Cited

U.S. PATENT DOCUMENTS

| | | | | |
|---|---|---|---|---|
| 4,634,019 | A * | 1/1987 | Pherigo | 220/810 |
| 5,040,834 | A | 8/1991 | Kahl et al. | |
| 5,125,697 | A * | 6/1992 | Kahl et al. | 292/204 |
| 5,145,087 | A * | 9/1992 | Weger, Jr. | 220/845 |
| D339,471 | S | 9/1993 | Maple et al. | |
| 5,322,178 | A | 6/1994 | Foos | |
| D349,646 | S | 8/1994 | Dickinson | |
| D355,765 | S | 2/1995 | Miller | |
| 5,452,847 | A | 9/1995 | Harris et al. | |
| D366,397 | S | 1/1996 | Zimmerman | |
| 5,507,385 | A | 4/1996 | Koloski et al. | |
| D370,345 | S | 6/1996 | Wolff | |
| D374,774 | S | 10/1996 | Cassel | |
| 5,564,805 | A | 10/1996 | Dickinson | |
| 5,573,162 | A | 11/1996 | Spencer et al. | |
| 5,575,401 | A | 11/1996 | Trower et al. | |
| D381,512 | S | 7/1997 | Green | |
| D390,007 | S | 2/1998 | Ahern, Jr. | |
| 5,718,350 | A | 2/1998 | Williams | |
| 5,769,260 | A | 6/1998 | Killinger et al. | |
| 5,906,291 | A | 5/1999 | Mann et al. | |

(Continued)

*Primary Examiner* — Fenn Mathew
*Assistant Examiner* — Kevin Castillo
(74) *Attorney, Agent, or Firm* — Boyle Fredrickson, S.C.

(57) ABSTRACT

A storage container according to the present invention includes a base and a lid hingedly coupled to one another to enable rotation of the lid between a closed position in which the lid is disposed parallel with a bottom wall of the base and an open position in which the lid is rotated with respect to the base between 110 and 230 degrees. A number of hinge assemblies are provided between the base and the lid for rotation of the lid thereabout. The hinge assemblies include a base engaging assembly and a lid engaging assembly for coupling between the base and the lid respectively. The lid engaging assembly includes a receiver configured to engage a pin of the lid for hinged rotation of the lid thereabout. The receiver is configured to enable the lid to break away from the lid as desired or under impact from an external force.

11 Claims, 11 Drawing Sheets

(56) References Cited

U.S. PATENT DOCUMENTS

| | | | |
|---|---|---|---|
| D414,934 | S | 10/1999 | Dickinson et al. |
| 6,085,928 | A | 7/2000 | Dickinson et al. |
| 6,131,760 | A | 10/2000 | Huang |
| 6,779,681 | B2 | 8/2004 | Doerfler et al. |
| 6,918,508 | B2 | 7/2005 | Hwang |
| 6,929,145 | B2 | 8/2005 | Shepler |
| 7,048,133 | B2 | 5/2006 | Pangerc et al. |
| 7,080,754 | B2 | 7/2006 | Lown |
| D567,507 | S | 4/2008 | Zimmerman |
| 7,370,772 | B2 | 5/2008 | Brunson |
| D618,516 | S | 6/2010 | DiPietro et al. |
| 2002/0179606 | A1 | 12/2002 | Houk, Jr. |
| 2004/0232040 | A1 | 11/2004 | Bowling |
| 2005/0146255 | A1 | 7/2005 | Sabo et al. |
| 2006/0186123 | A1 | 8/2006 | Baitz et al. |
| 2007/0001561 | A1 | 1/2007 | Sabo et al. |
| 2008/0250605 | A1* | 10/2008 | Park ..... 16/268 |
| 2009/0321434 | A1 | 12/2009 | Rothschild et al. |
| 2010/0193393 | A1 | 8/2010 | Humm et al. |

* cited by examiner

STORAGE CONTAINER

BACKGROUND OF THE INVENTION

1. Field of the Invention

The present invention relates to storage containers, and more particularly, to storage containers having a base and a lid coupled together by way of a hinge assembly for selectively opening and closing the storage container for selective access to the contents of the storage container.

2. Discussion of the Related Art

Storage containers are well known in the art. Typical storage containers include a base having a number of walls that cooperate to define a cavity and an opening through which items to be stored within the cavity may be introduced. These storage containers oftentimes include a lid that may be placed over the opening to prevent access to or protect the contents of the storage container. The lid may be provided either completely separate from the base and secured to the base by snapping or otherwise mechanically engaging the lid with a portion of the base surrounding the opening. In other instances, the lid may be hingedly coupled to the base such that the lid remains attached to the base and is movable between a closed position in which the lid covers the opening and an open position in which the lid is rotated about the hinges of the storage container to a position being slightly past vertical such that the lid may come to rest once it reaches the open position.

A latch element may be provided to selectively lock the lid to the base to prevent removal of the lid from the base. A locking device such as a padlock or the like may be provided in some cases for further securing the contents of the storage container by preventing the latch element from being opened while the locking device is in place. These storage containers are commonly constructed of a plastic material or similarly durable material formed through a molding process just as blow molding or similar such process.

Storage containers of this type suffer from a number of known disadvantages. For storage containers in which the lid is entirely separable from the base, the lid may become lost or may be easily damaged or discarded rendering the storage container less than suitable for providing secure storage for the contents of the storage container. Where the lid is hingedly coupled to the base, storage containers of this type typically have hinge constructions that are generally weak and susceptible to being damaged through repeated or careless use. Further, hinges of this type are constructed such that the lid is not releasable from the hinge. Accordingly, when the lid is opened harshly or an external force such as a gust of wind or an object contacts the lid when it is in its opened position, the hinges are susceptible to failure and may break under the applied force therefore rendering the storage container unsuitable for secure storage of items therein. Further, known hinges allow for the lid to be rotated to a point slightly past vertical such that the lid may come to rest in an open position without requiring the user to hold the lid so that the user may more easily access the contents of the storage container. However, when the lid is maintained in this position, it is susceptible to being subjected to further wear and tear particularly about the hinges.

Yet another disadvantage of storage containers of the prior art including a hinged construction is that the storage containers are relatively difficult and expensive to transport. In particular, storage containers of this type cannot be nested or stacked with one another because the lids of the storage containers interfere with the stacking thereof. Accordingly, such storage containers must be transported on pallets or the like individually, which takes up a great deal of space, which understandably increases the cost of transporting such containers from a manufacturing facility to distributors and retailers. Further, once the storage containers reach their final destination, e.g. point of sale, because they cannot be stored in a nested or stacked manner, they take up a considerable amount of shelf space thereby limiting the number of units that a retailer may keep in stock at a given time.

A storage container that overcomes one or more of the foregoing identified disadvantages is therefore desired.

SUMMARY AND OBJECTS OF THE INVENTION

A storage container according to the present invention includes a base hingedly coupled to a lid. The base includes a number of walls that define a cavity and an opening through which the contents to be stored within the base may be introduced. The base and the lid may be formed by way of a conventional molding process such as blow molding and may be constructed from a plastic or similarly durable material. The base and the lid may additionally be formed from double walled plastic to further enhance the structural integrity of the storage container for protecting the contents stored therein.

The base may have one or more apertures formed near an upper edge of the base. The apertures may be formed after the molding process by way of punching or other such means of mechanical formation. The base may additionally include at least one undercut portion formed during the molding process. The lid may include one or more pins arranged at one edge thereof for rotation of the lid with respect to the base between an open position and a closed position.

The lid is coupled to the base by one or more hinge assemblies. The hinge assemblies may be constructed of a plastic material and may be constructed through a separate molding process such as, for example, injection molding. The hinge assemblies include one or more hook elements configured to engage the apertures of the base to thereby couple the hinge assemblies to the base. The hinge assemblies may include, on an opposing end thereof, a pawl or finger element configured to engage the undercut portion of the base. The combination of the hook elements and the pawl elements serves to act in opposition with one another to further secure the hinge assemblies to the base.

The hinge assemblies further include one or more receivers. The receivers may have a C-shaped construction and are configured to receive the pins of the lid. In particular, the pins of the lid may be snap fit into the space defined by the receivers to secure the lid to the hinge assembly. The receivers of the hinge assemblies are configured to allow for the lid to be selectively removed from the hinge assemblies and thereby the base. Accordingly, when exposed to excess force, the lid may simply break away from the base so that the hinge assembly is not damaged by being subjected to excess torque.

In addition, the lid may be maintained separately from the base during transport and at the point of sale. Accordingly, a number of bases may be nested with one another to reduce the amount of space necessary during transport and on the shelves at the point of sale.

Moreover, the construction of the hinge assembly allows for the lid to be rotated well past vertical. In at least one construction of the storage container of the present invention, the lid may be rotated about the hinge assembly between approximately 110 and 230 degrees relative to the closed position.

The storage container may additionally include a latch coupled to the base and configured to engage a portion of the lid to further secure the lid in place. The latch along with the hinge assembly is configured such that the lid may not be removed when it is in its closed position.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DETAILED DESCRIPTION

Figure 1:
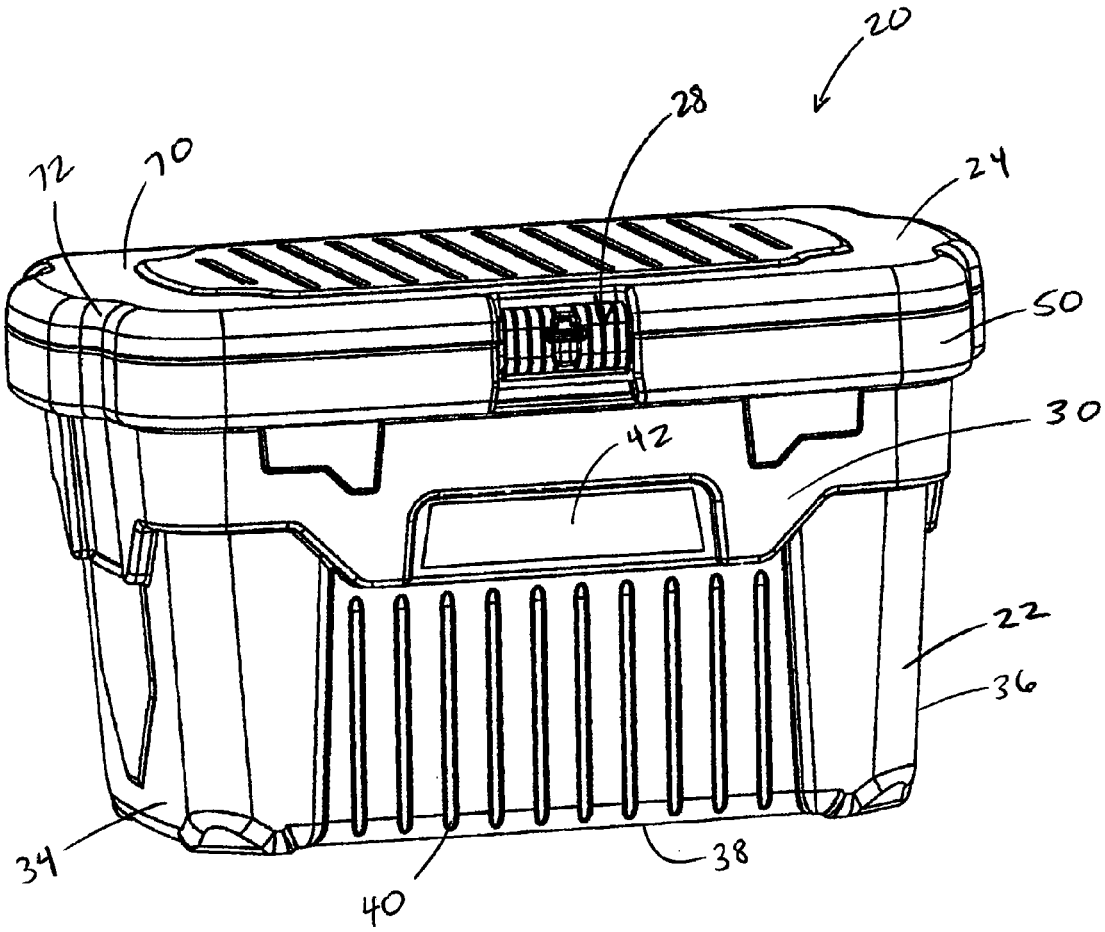
FIG. 1 is an isometric view of a storage container according to the present invention with a lid of the storage container in a closed position.

The present invention and the various features and advantageous details thereof are explained more fully with reference to the non-limiting embodiments described in detail in the following description.

Referring now to the drawings, and initially FIGS. 1-4, a storage container 20 according to the present invention is illustrated. Storage container 20 includes a base 22 and a lid 24 hingedly coupled to one another by a pair of spaced hinge assemblies 26 provided on a rear of the storage container 20. A latch element 28 is provided on a front of the storage container 20 for selectively locking the lid 24 to the base 22.

Base 22 may be constructed from any relatively durable material such as plastic for example. In at least one construction of base 22, the base 22 is constructed as a dual wall construction of a plastic material. In another embodiment, the base 22 is constructed as a single wall through a blow molding process. Base 22 may be constructed through any other conventional process as is generally understood. Base 22 includes a front wall 30, and opposing rear wall 32, a pair of opposing end walls 34, 36, and a bottom wall 38 that together define a cavity for storing items within storage container 20. The base 22 includes an opening through which the items may be introduced and which is selectively coverable by the lid 24 as will be discussed herein.

Figure 2:
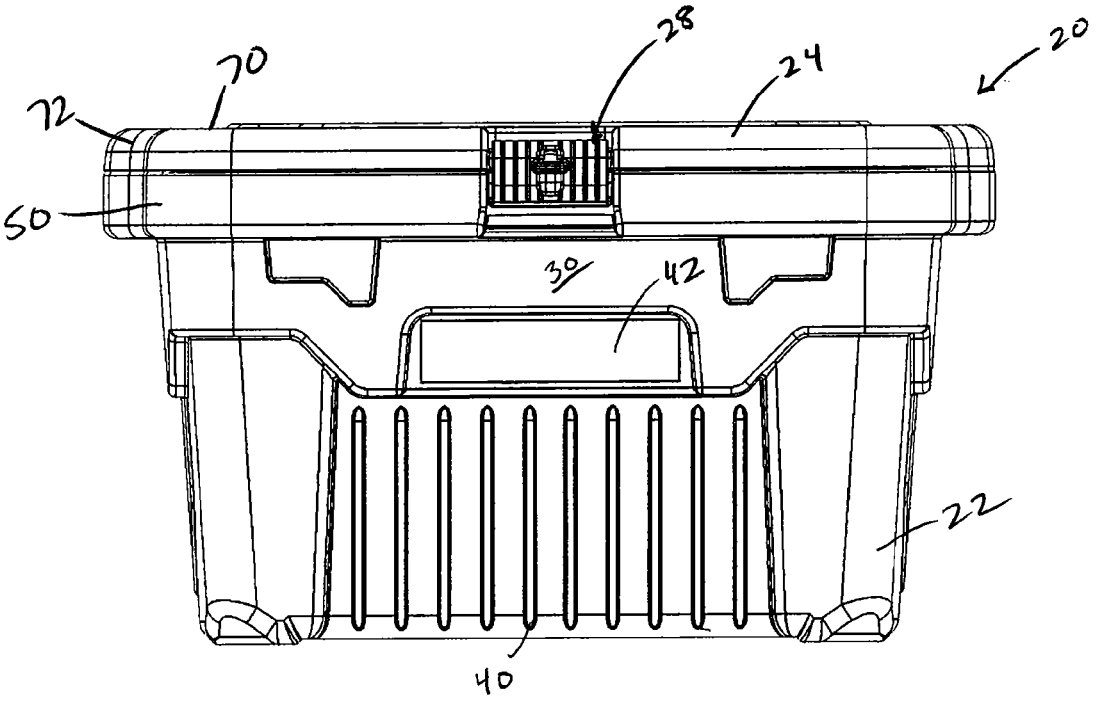
FIG. 2 is a front elevation view of the storage container of FIG. 1.
Figure 3:
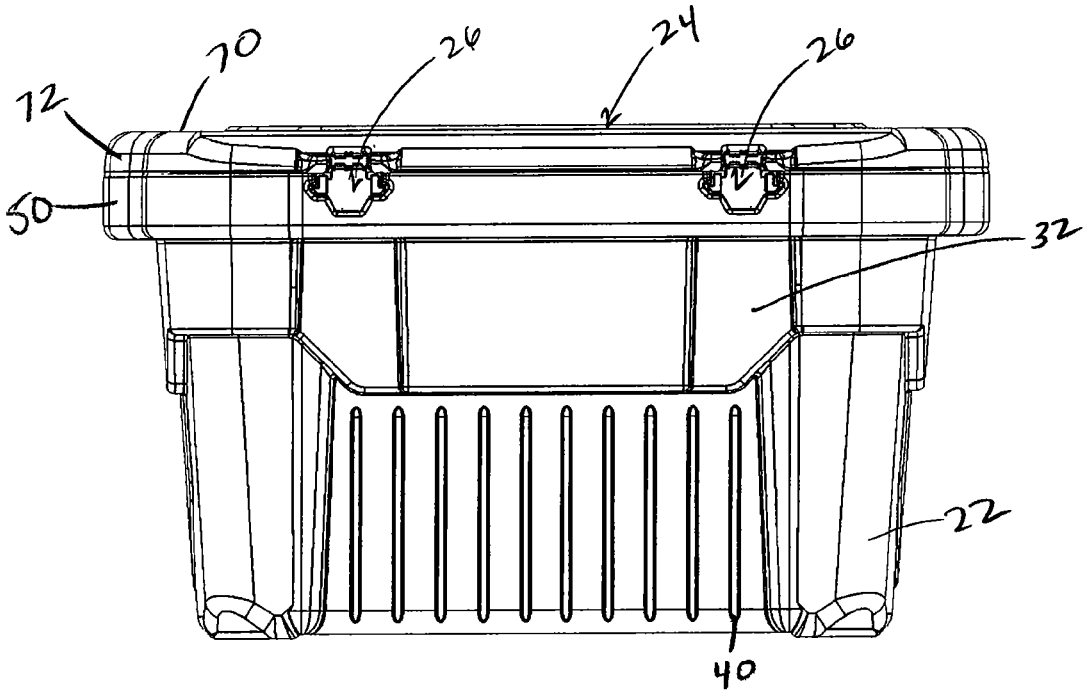
FIG. 3 is a rear elevation view of the storage container of FIG. 1.
Figure 4:
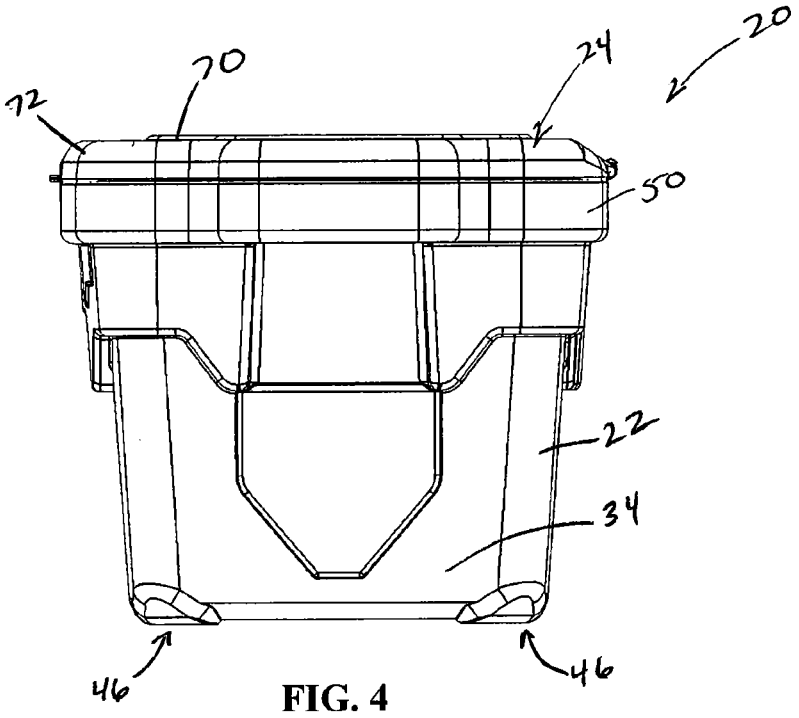
FIG. 4 is a side elevation view of the storage container of FIG. 1 wherein the opposing side comprises a similar construction.

Base 22, as illustrated has a generally rectangular cross section, although it is understood that base 22 may have any alternative construction in keeping with the spirit of the present invention. Referring now to FIG. 2 in particular, the front wall 30 of base 22 is illustrated. Front wall 22 includes a number of spaced, vertically extending depressions 40 adjacent a lower edge of front wall 22. Depressions 40 may be provided for increasing the structural stiffness of base 22 and for facilitating nesting of one or more additional bases with one another. Base 22 may further include embossed or otherwise formed indicia 42 across a portion of front wall 30 for identifying, for example, a product, manufacturer, model name, or the like. Turning now to FIG. 3, rear wall 32 may include a construction much like that of front wall 30 including one or more depressions 40 formed over a surface thereof. Referring now to FIG. 4, a representative view of one of end walls 34, 36 is illustrated. As shown, end walls 34, 36 have a generally rectangular shape and may include one or more depressions (not shown) like those of front wall 30 and rear wall 32. The walls 30, 32, 34, and 36 may slope downwardly as shown.

Figure 5:
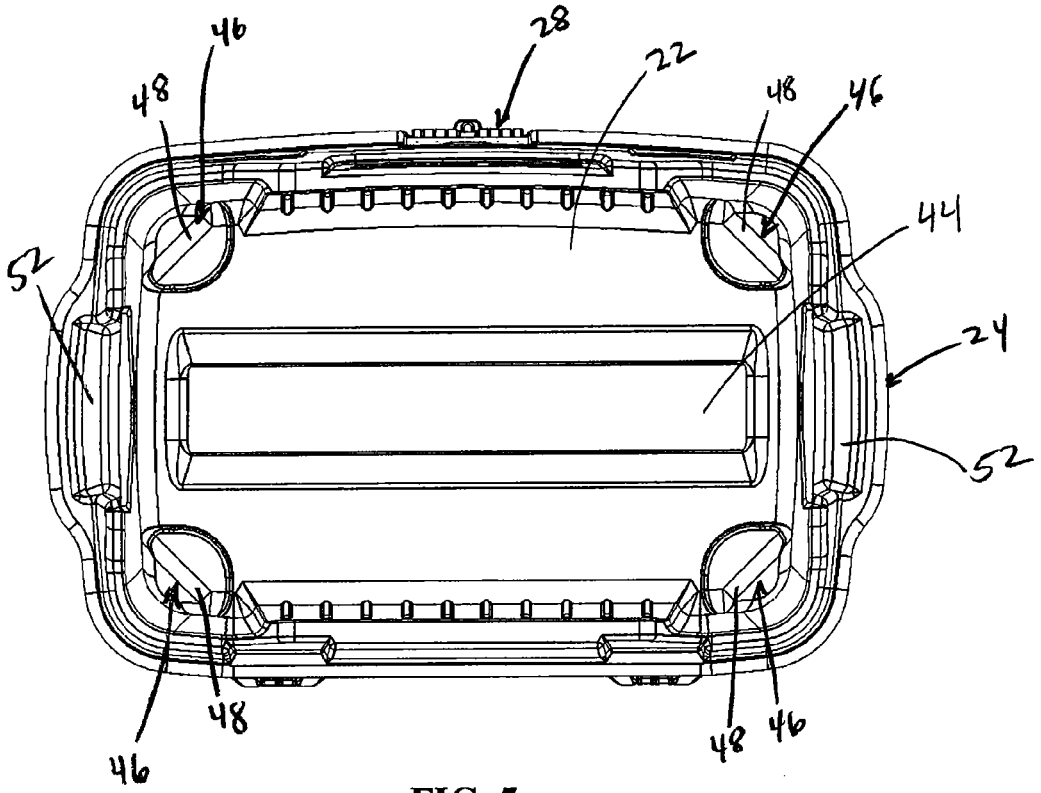
FIG. 5 is a bottom plan view of the storage container of FIG. 1.

Referring now to FIG. 5, a view of the exterior of bottom wall 38 of base 22 is provided. Bottom wall 38 may include one or more depression 44 over a portion of the surface thereof. Again, depression 44 may be configured for increasing the structural integrity of the base 22. Moreover, bottom wall 38 may further include a number of support element 46 mounted to each of the corners thereof. Support elements 46 may be configured to wrap around the corner between the bottom wall 38 and over a portion of the end walls 34, 36 and/or front wall 30 and rear wall 32. Support elements 46 may be configured to provide a sturdy support for the base when it is supported on a surface. Further, support elements 46 may include additional structure configured to prevent the base from sliding across the surface on which it is supported. In particular, support elements 46 include a generally beveled edge 48 configured to resist sliding movement of base 22.

Base 22 extends upwardly from bottom wall 38 and terminates in an outwardly flanged perimeter 50 that extends around the entire periphery of base 22. Of course, flanged perimeter 50 may be configured to only extend outwardly from a portion of base 22 or may include additional contours or the like. Referring again to FIG. 4, perimeter 50 may include one or more recesses 52 formed on an underside thereof. Recesses 52 are configured for receiving the user's fingers and/or hand to enable the user to comfortably carry the storage container 20. In particular, in at least one construction of the present invention, each end wall 34, 36 includes a single recess 52 generally aligned with one another so that the user may comfortably grasp the recesses on each side for carrying the base 22. Alternative constructions of the base are within the scope of the present invention whereby the base 22 may be entirely devoid of recesses or may include one or more additional recesses along each end wall 34, 36 or along one or both of the front wall 30 and rear wall 32. Further, base 22 may include one or more graspable handles integrally formed with or otherwise secured to one or more of the front wall 30, rear wall 32, and end walls 34, 36. Handles of this type are well known throughout the art and may be rigidly coupled to the base 22 or may include means for enabling the handle to hingedly or otherwise rotate to make grasping thereof more comfortable.

Turning now to FIGS. 1, 2, 7A, and 7B, a latch element 28 coupled to front wall 30 about perimeter 50 is provided. Understandably, latch element 28 may be coupled to one side walls 34, 36 or one or more additional latching assemblies may be provided along one or more of front wall 30 and side walls 34, 36. Latch element 28 is configured to selectively engage lid 24 for securing lid 24 to the base to cover the opening of base 22 as is generally understood. Latch element may include a pivot pin 58 mounted to perimeter 50 in a recessed portion 60 thereof. In particular, pivot pin 58 may extend horizontally across the recessed portion 60 and defines an axis about which the latch element pivots for selectively engaging the lid 24. Latch element 24 further includes a body 62 that extends upwardly from pivot pin 58 and which has a generally U-shaped construction. Body 62 may include one or more grooves or raised surfaces 64 across the length thereof for providing a user with tactile feedback when gripping the latch element 28. Body 62 may further include a longitudinally extending recess 66 and a laterally extending aperture 68. Recess 66 and aperture 68 are configured to accommodate a locking element, e.g. padlock or combination lock and a portion of lid 24 respectively for enabling the further securing of latch element 28 to lid 24 as will be discussed in greater detail herein.

Latch element 28 may be formed by way of the molding process. In at least one construction of the present invention, latch element 28 is formed by a separate molding process and coupled to base 22 after the molding of base 22. In particular, after base 22 is created via blow molding or a similar molding process and during the curing process in which base 22 is cooling, the pivot pin 60 may be inserted into the sides of perimeter 50 defining recess 66 to thereby couple the latch element 28 to base 22. This is done during cooling of the base so that no other holes or other such receiving elements in the base 22 are required. Further this provides a more structurally rigid base. In this manner, as the base 22 continues to cure/cool after the insertion of pivot pin 60, the pivot pin 60 becomes secured to the base 22 by way of a snug physical fit therebetween. Body 62 therefore includes a portion configured to be received about pivot pin 60 to enable rotation therearound.

It is understood that the construction of base 22 described herein is merely exemplary and that the base may be configured in any number of alternative manners including the absence of one or all of the aforementioned features.

Referring again to FIGS. 1-4 and FIG. 6, lid 24 according to the invention may be formed by way of a similar molding process of base 22. Lid 24 may be constructed from the same or similar material as base 22. Lid 24 is molded in a separate molding operation as that of base 22. In at least one construction of lid 24, lid 24 has a dual wall construction. Lid 24 includes a generally flat top 70 and a flanged perimeter 72 that extends downwardly from top 70 around the entire periphery of lid 24. Top 70 may include depressions 71 across a surface thereof for increasing the rigidity thereof. Lid 24 generally has a size and shape configured to cooperate with base 22 so as to be receivable over the opening of base 22 in a substantially secure manner. Lid 24 is configured to provide a water resistant seal about base 22 so as to prevent damage to the contents of base 22 as is generally recognized. A front 74 of lid 24 includes a recessed portion 76 for accommodating the latch element 28. In particular, recessed portion 76 includes a cutout portion that defines a ledge 78 configured to receive body 62 of latch element 28. In particular, ledge 78 is configured to receive an upper edge of body 62 such that upper edge of body 62 is snap-fit over the ledge 78. More particularly, ledge 78 may include an aperture, recess, or other receiving element 80 configured to matingly receive a corresponding tab 82 secured to the upper edge of body 62.

Recessed portion 76 may further include a protrusion 82 extending forwardly with respect to lid 24 and may include a lock receiving aperture 84. Lock receiving aperture 84 is configured to receive a padlock, combination lock, or similar lock (not shown) therethrough. That is, the aperture 84 is sized and shaped to receive a hasp or other such locking element of the lock. As previously noted, latch element 28 includes a longitudinally extending recess 66, which understandably may be provided to accommodate the lock in a relatively tight fitting manner such that the lock is closely held to the latch element 28. Accordingly, as desired, when the latch element is engaged with the lid 24, a user may insert a lock through the aperture 84 to prevent an unauthorized user from opening the lid 24 to access the cavity of the base 22.

Figure 6:
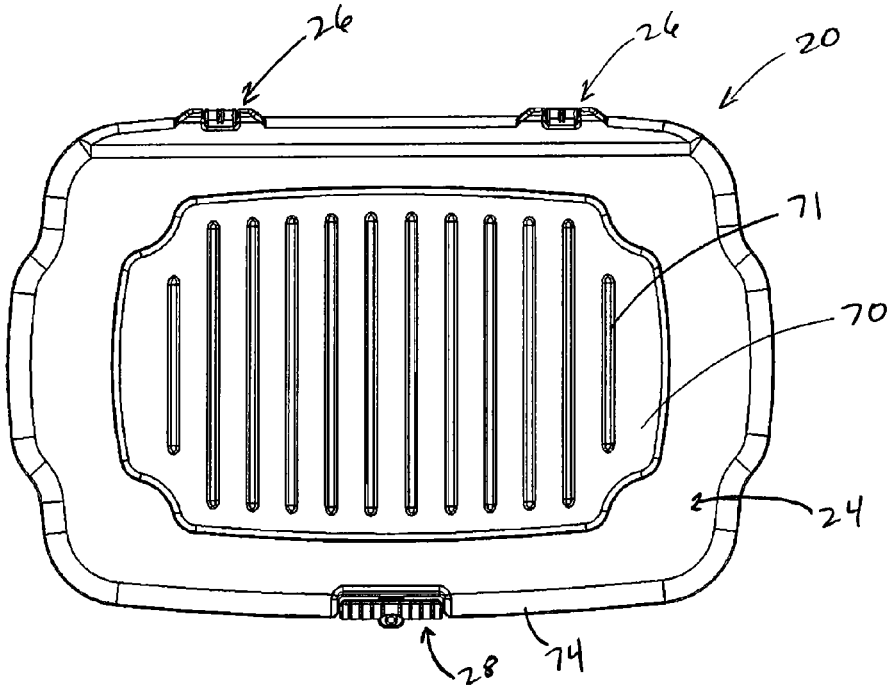
FIG. 6 is a top plan view of the storage container of FIG. 1
Figure 12B:
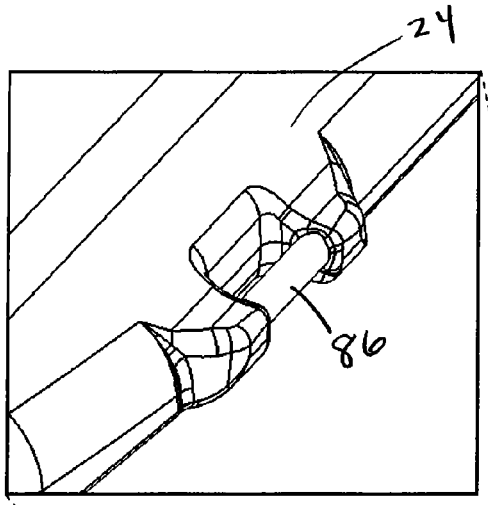
FIG. 12B is a partial view of the lid of FIG. 12 showing a pin thereof.
Figure 12A:
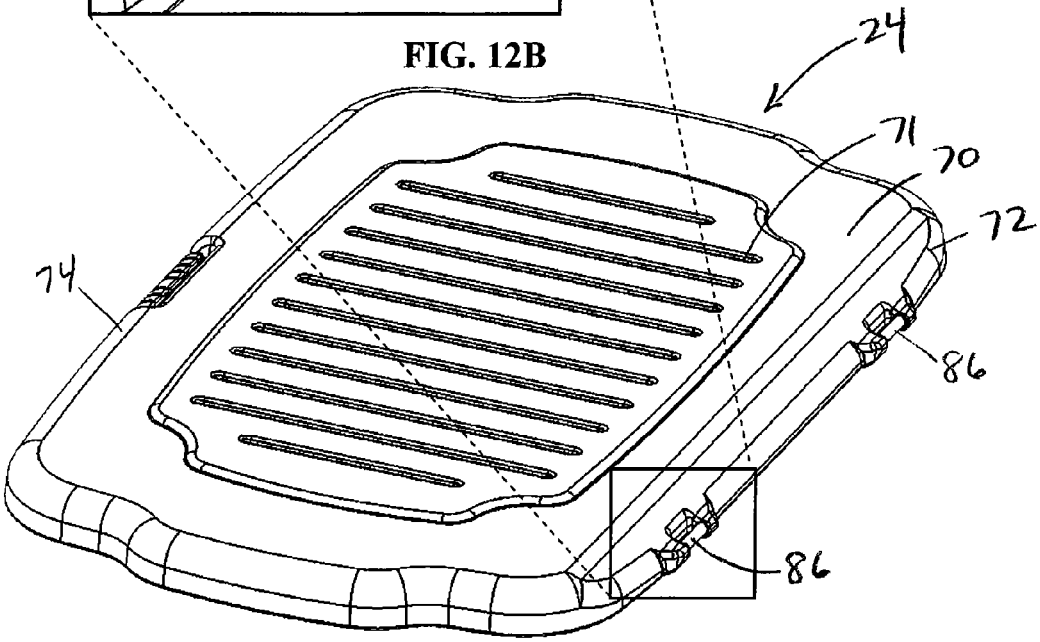
FIG. 12A is an isometric view of the lid.

Referring now to FIGS. 6, 12A, and 12B, lid 24 includes a pair of pins 86 proximate a rear edge thereof. Pins 86 are integrally formed with lid 24 and may include a generally circular cross section or any other such cross section capable of operating in the manner intended and as will be described herein. Understandably, lid 24 may include one or more additional pins 86 or may include only a single pin 86, which may be centrally located along a length of lid 24. Lid 24 may define apertures 88 between lid 24 and pins 86 for receiving a portion of hinge assembly 26 as will now be discussed.

Figure 8:
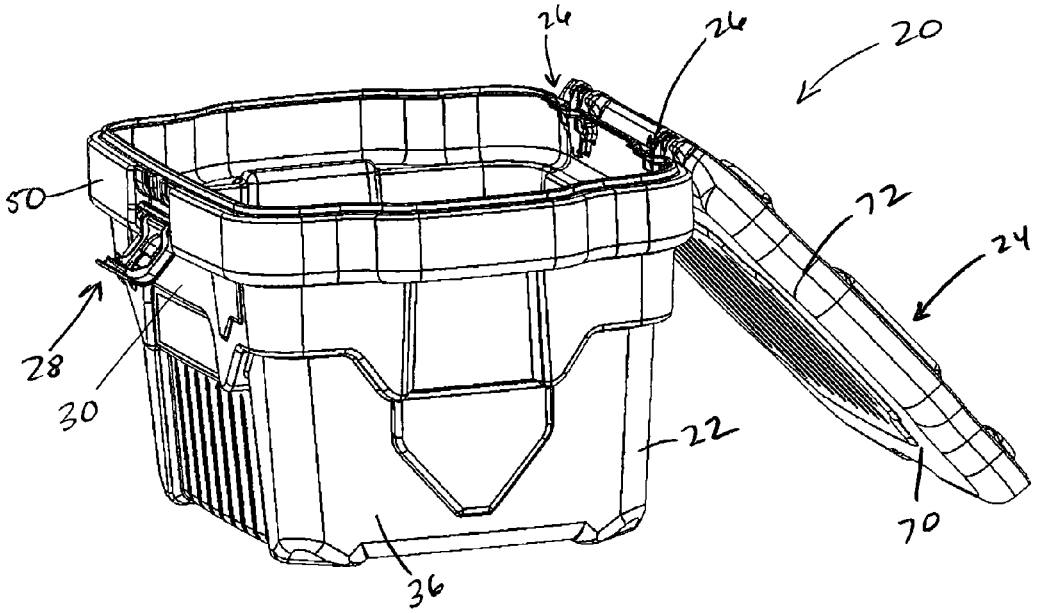
FIG. 8 is an isometric view of the storage container of FIG. 1 with the lid of the storage container rotated to an open position.
Figure 7A:
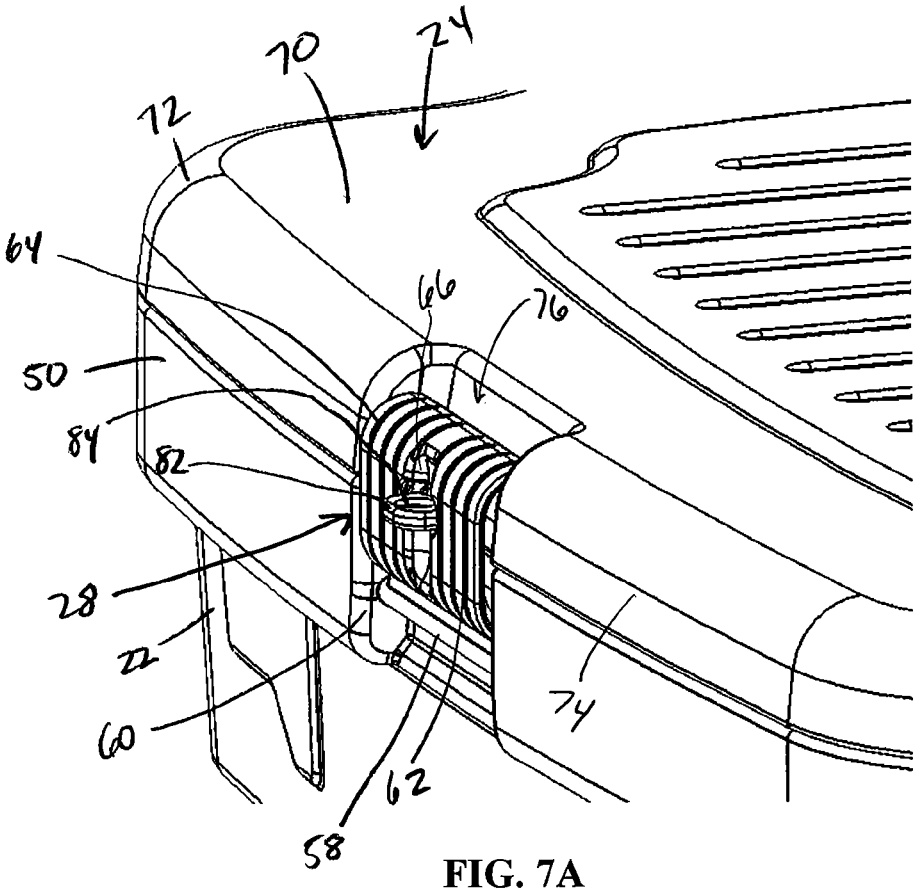
FIG. 7A is a partial view of the storage container of FIG. 1 showing a detailed view of a latch element in an engaged position.
Figure 7B:
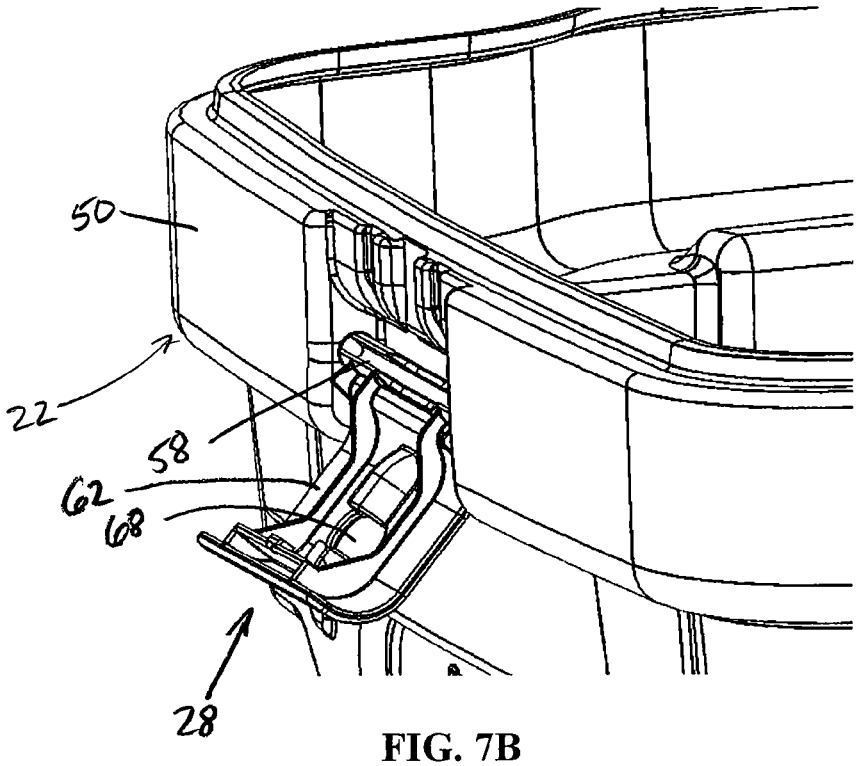
FIG. 7B is a partial view of the storage container of FIG. 1 like that of FIG. 7A, showing a detailed view of the latch element in a disengaged position.
Figure 9:
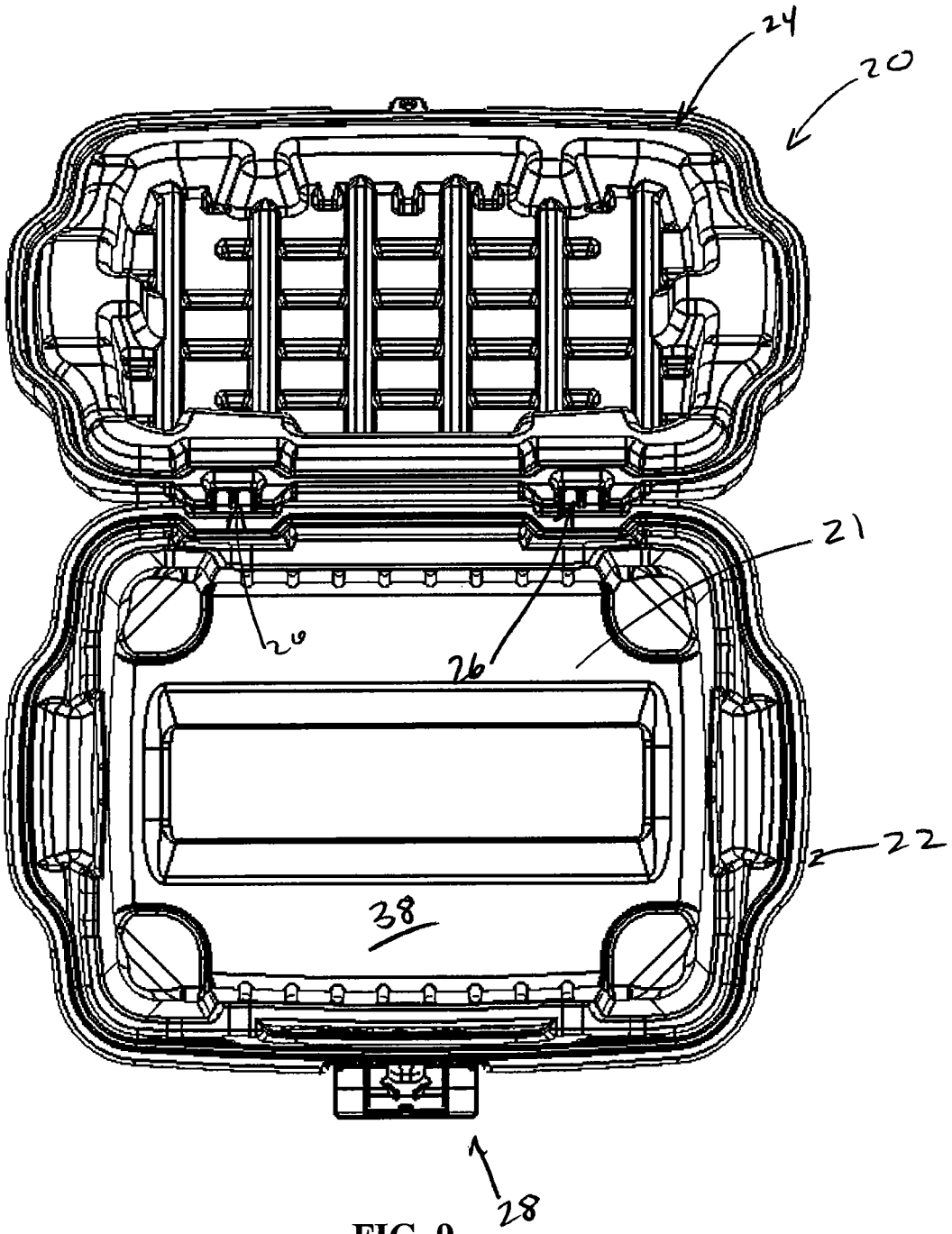
FIG. 9 is a top plan view of the storage container as shown in FIG. 8 illustrating a cavity thereof.

Referring now to FIGS. 8-12B, and initially FIGS. 8, and 9, lid 24 is shown rotated about the hinge assemblies 26 to an open position. Momentarily referring to FIG. 9, cavity 21 of the base 22 is illustrated. The cavity 21 according to the invention is generally rectangular in shape and may house any number of items therein. Understandably, storage container 20 according to the invention may be provided in any number of sizes and shapes in keeping with the spirit of the invention. In one construction of the present invention, base 22 may have a height of approximately 11 inches, a length of approximately 21 inches, and a width of between approximately 11.5 inches and 15.7 inches. Lid 24 may have a height of approximately 1.5 inches, a length of 21 inches and a width of approximately 15.7 inches. As can be appreciated, base 22 may have a tapered shape such that a width of the base 22 may be relatively narrow near bottom wall 38 and a relatively wider width as the base 22 extends from bottom wall 38. Of course, base 22 may have a uniform width across the entirety thereof.

Figure 10:
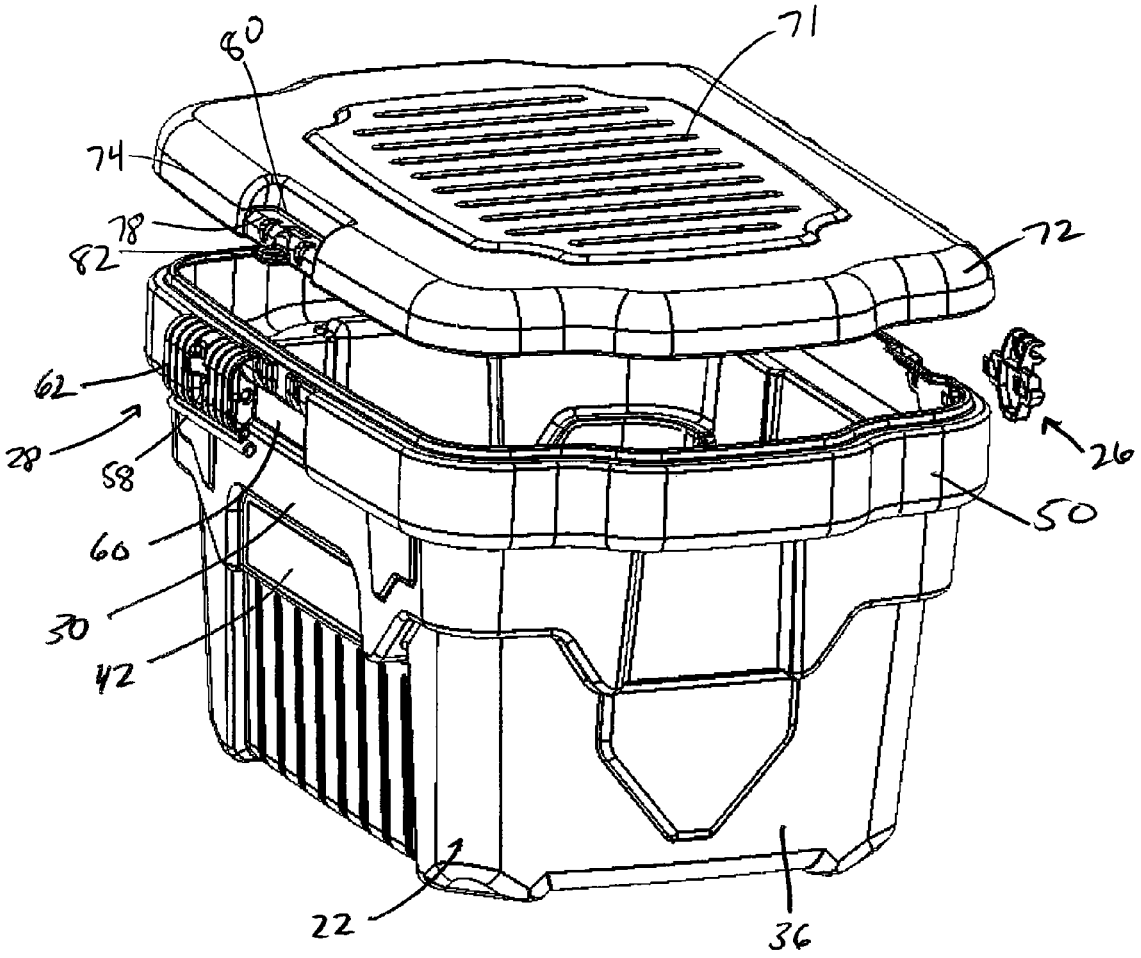
FIG. 10 is an exploded view of the storage container of FIG. 1.
Figure 11A:
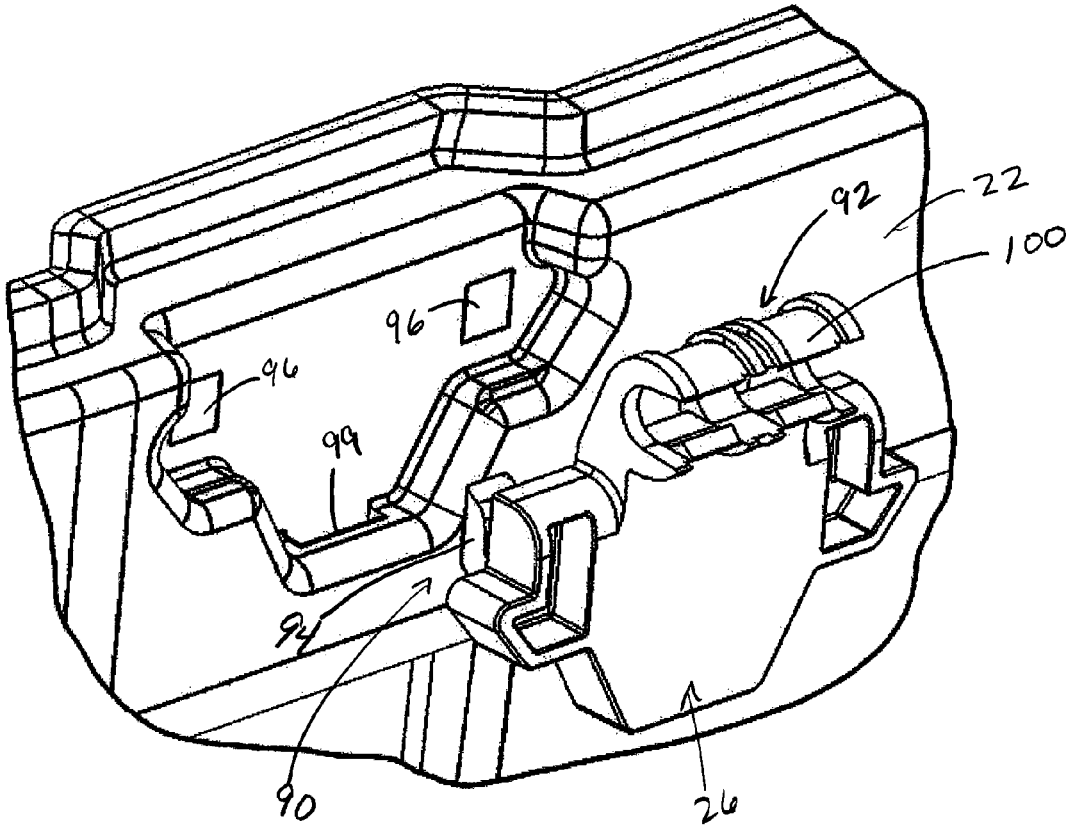
FIG. 11A is a partial view of the storage container of FIG. 1 showing a detailed view of the construction of a hinge assembly thereof.
Figure 11B:
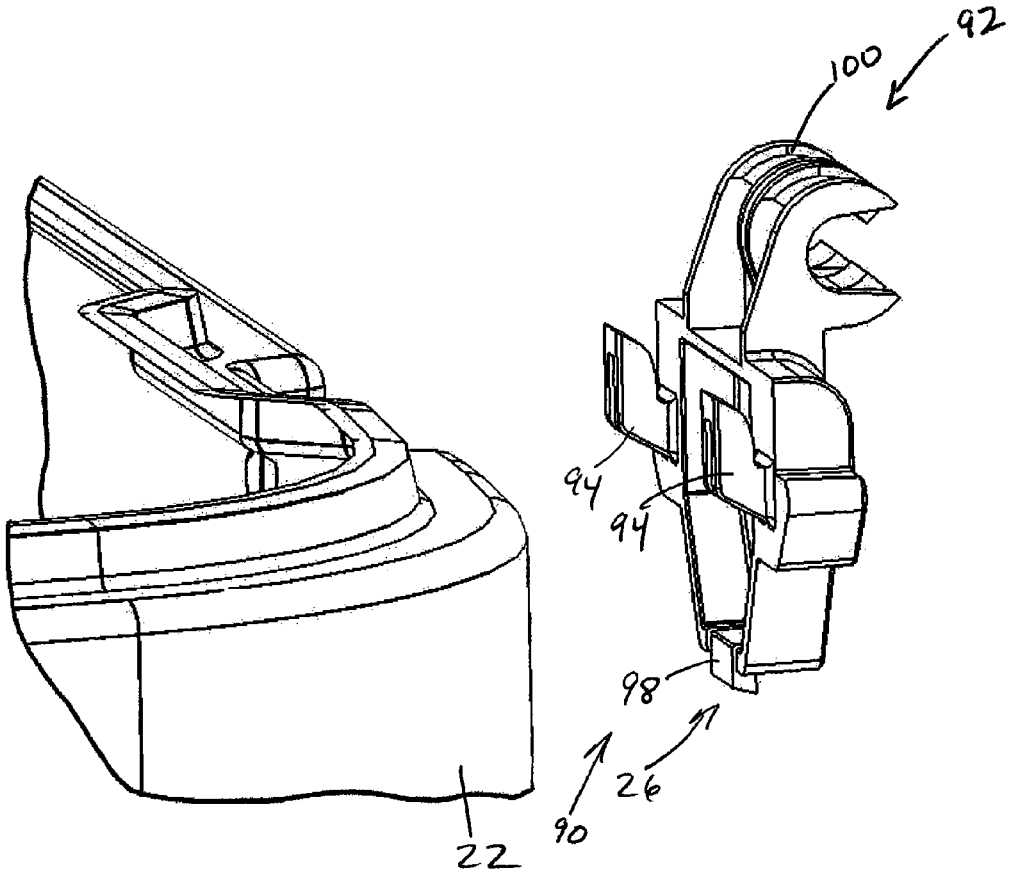
FIG. 11B is a partial view of the hinge assembly of FIG. 11A shown from an opposite side.

Now turning to FIGS. 10, 11A, and 11B hinge assemblies 26 are shown in further detail. Hinge assemblies 26 are identically constructed and therefore reference to one of the hinge assemblies 26 applies equally to the other of the hinge assemblies. Hinge assemblies 26 are constructed from a plastic or similarly durable material through a separate process from that from which the lid 24 and base 22 are constructed. In at least one construction of storage container 20, hinge assembly 26 is formed by way of an injection molding process of the kind generally known in the art.

Hinge assemblies 26 include a base engaging assembly 90 and a lid engaging assembly 92 for coupling the hinge assemblies 26 to the base 22 and lid 24 respectively. Base engaging assembly 90 includes a pair of hook elements 94 on opposing ends of hinge assemblies 26. Hook elements 94 are configured to be received in a pair of corresponding apertures 96 in base 22. Apertures 96 may be formed after the cooling and curing of base 22 subsequent to the molding or other such forming thereof. In particular, apertures 96 may be punched or otherwise formed through the wall of the base 22 and sized and shaped to receive hook elements 94. Hook elements 94 may be integrally formed with hinge assemblies 26. Understandably, hinge assemblies 26 may be arranged to include one or more additional hook elements 94 or may include only a single hook element 94 for coupling to a corresponding single aperture 96. Of course, hinge assemblies 26 may be mounted to base 22 in another manner as well such as through alternative mechanical means or by way of an adhesive or similar such means. Hinge assemblies 26 further include a downwardly extending finger or pawl element 98 disposed at a lower edge thereof that is configured to engage an undercut portion 99 of base 22. In this manner, the combination of pawl element 98 and hook elements 94 operate in opposition to one another to thereby secure hinge assemblies 26 in place to prevent the removal thereof.

Lid engaging assembly 92 is disposed at an upper edge of hinge assemblies 26 and includes a rearwardly facing receiver 100. Receiver 100 may have a generally C-shaped construction and may include one or more receiver elements disposed adjacent one another and configured to operate in tandem. Receivers 100 are configured to be inserted through apertures 88 of lid 24 and snap fit over pins 86.

Now referring back to FIGS. 8 and 9, rotation of lid 24 about hinge assemblies 26 is shown. As illustrated, hinge assemblies 26 are configured to enable lid 24 to be rotated well past vertical, i.e. 90 degrees with respect to base 22. In particular, hinge assemblies 26 are configured to enable rotation of lid 24 of approximately between 110 degrees and 230 degrees. In this manner, as best shown in FIG. 8, lid 24 may be rotated such that a forward edge of lid 24 may come to rest on the support surface supporting storage container 20. Of course, hinge assembly 26 may be configured such that the lid 24 does not come to rest on the ground or so that it may rotate to a lesser extent. In either case, hinge assembly 26 is configured such that lid 24 may be selectively removable from hinge assembly 26. As receivers 100 are C-shaped, or some other such shape configured to allow for removal of pins 86 from hinge assemblies 26, the lid 24 may be removed from hinge assemblies 26 by the user by simply pulling the lid 24 away from the hinge assembly 26 while lid 24 is in the open position. In addition, hinge assemblies 26 are configured such that the lid 24 may be removed when a particular load is applied to the lid 24. In this manner, hinge assemblies 26 are not damaged due to excess torque applied thereto by lid 24, but rather, lid 24 simply breaks away from hinge assemblies 26 and base 22.

Figure 13:
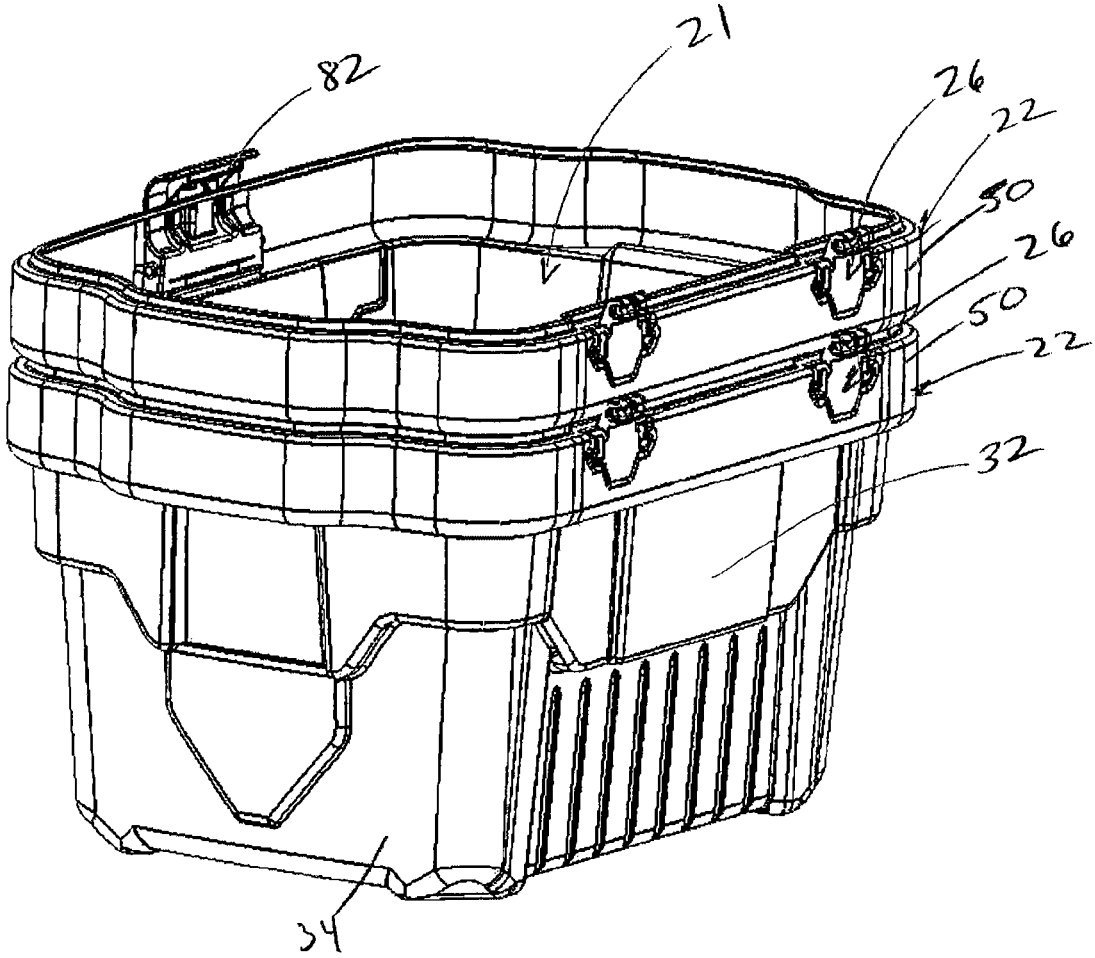
FIG. 13 is an isometric view of two bases according to the present invention nested with one another for transport thereof.

Turning now to FIG. 13, an exemplary illustration of a pair of bases 22 nested together for transport thereof is shown. Understandably, as desired, lids 24 may be removed from bases 22 to enable one or more additional bases to be nested or stacked together with a base 22. In this manner, a number of bases 22 may be transported or stored in a relatively condensed manner. In such cases, as desired, lids 24 may simply be stacked on top of bases 22 for transport or disposed entirely separately therefrom.

In one preferred embodiment, six bases are nestably stacked together and then six lids are stacked on top of the topmost base. This "six pack" configuration is then shrink wrapped with plastic or otherwise packaged as a single unit for shipping. Once the "six pack" arrives at a retailer, the outer packaging is removed. The nested "six pack" is then displayed in stacked form for purchase by customer. At the point of purchase, the customer removes one lid from the top of the stack. The customer next removes one base to match the lid and proceeds to the checkout counter to purchase. Once the consumer arrives at its destination, the base and lid may be coupled for storage.

One method of constructing a storage container includes blow molding a base with a plurality of sides that define a cavity between the plurality of sides and a top opening. A lid may next be blow molded and configured to be received over the opening of the base. The lid preferably has at least one pin. At least one aperture is formed or punched into the base. A hinge assembly is then injection molded with a hook configured for engaging the at least one aperture in the base. The hinge is then preferably coupled to the base. At least one pin of the lid is next coupled to enable rotation of the lid with respect to the pin from a closed position to an open position. As mentioned above, the lid pin may be removed from the hinge assembly for shipping or storage.

There are virtually innumerable uses for the present invention, all of which need not be detailed here. Of course, this and all of the other disclosed embodiments can be practiced without undue experimentation.

Further, although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. In addition, the individual components need not be fabricated from the disclosed materials, but could be fabricated from virtually any suitable materials. For example, construction materials for the container could be of: metal, glass, stone, resin, clay, a transparent material, or some other manmade material.

Moreover, the individual components need not be formed in the disclosed shapes, or assembled in the disclosed configuration, but could be provided in virtually any shape, and assembled in virtually any configuration. Further, although various components as described herein as physically separate modules, it will be manifest that they may be integrated into the apparatus with which they are associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

I claim:

1. A storage container comprising:

a base including a bottom wall and a plurality of sides defining a cavity therebetween and an opening opposite the bottom wall;

a lid receivable over the opening;

an injection molded hinge assembly coupled to the base and the lid and configured to enable the lid to hingedly rotate with respect to the base to move between a fully open position and a closed position, and wherein when the lid is in the open position the lid is selectively removable from the hinge assembly and when the lid is in the closed position, the lid cannot be removed from the hinge assembly; and wherein the hinge assembly includes a hook and the base includes an aperture through which the hook is received to couple the hinge assembly to the base and wherein the hinge assembly includes a pawl element disposed opposite the hook and the base includes an undercut portion configured to receive the pawl element.

2. The storage container of claim 1, wherein the lid comprises at least one pin configured to be received by the hinge assembly for rotation of the lid about the pin.

3. The storage container of claim 2, wherein the lid includes an opening disposed between the pin and a remainder of the lid and wherein a portion of the hinge assembly is received through the opening.

4. The storage container of claim 3, wherein the hinge assembly comprises a C-shaped receiver configured to receive the pin within an opening defined by the C-shaped receiver, and wherein the C-shaped receiver is the portion of the hinge assembly received through the opening of the lid.

5. The storage container of claim 1, wherein the hinge assembly comprises a plurality of hinges disposed along a horizontal axis of the storage container.

6. The storage container of claim 5, wherein the plurality of hinges include a C-shaped receiver and the lid includes a plurality of pins configured to be received by the C-shaped receivers of the plurality of hinges.

7. The storage container of claim 1, wherein the pawl element and the hook are configured to work in opposition to one another with respect to the base to thereby secure the hinge assembly to the base.

8. The storage container of claim 1, wherein when the lid is in the closed position the lid is parallel to the bottom wall and when the lid is in the fully open position the lid is oriented at an angle of rotation with respect to the base of between 110 degrees and 230 degrees.

9. The storage container of claim 1, wherein when the lid is removed from the base, the base is selectively stackable with at least one additional base, wherein the at least one additional base is received within the cavity defined by the plurality of sides to minimize the amount of space taken up by the base and the at least one additional base.

10. The storage container of claim 1, further comprising a latch element coupled between the base and the lid and configured to lock the lid to the base when the lid is in the closed position such that the lid is not removable from the base and wherein the latch element comprises, a latch pin received by the base;

a latch body that is selectively rotatable about the latch pin between an engaged position in which the latch body is configured to engage the lid to lock the lid with respect to the base and a disengaged position in which the latch body is disengaged from the lid to enable hinged movement of the lid about the hinge assembly, and wherein the latch body includes an aperture for receiving a protrusion of the lid therethrough, and wherein the protrusion of the lid is configured to selectively receive a lock for securing the lid with respect to the base.

11. A storage container comprising:

a base;

a lid including a plurality of pins;

a plurality of hinge assemblies coupled to the base and to the pins of the lid and configured to enable the lid to hingedly rotate about the pins with respect to the base between a closed position and a fully open position, and wherein when the lid is in the fully open position, the lid is selectively removable from the hinge assembly and when the lid is in the closed position, the lid cannot be removed from the hinge assembly, wherein each of the plurality of hinge assemblies comprises:

a base mounting assembly for coupling each of the plurality of hinge assemblies to the base, wherein the base mounting assemblies comprise a hook on one end of the hinge assembly and a pawl element on an opposing end of the hinge assembly, and wherein the base includes a plurality of apertures and a plurality of undercut portions and wherein the hooks of the base mounting assemblies are engagable with the plurality of apertures and the pawl elements are engageable with the plurality of undercut portions; and a lid mounting assembly for coupling each of the plurality of hinge assemblies to one of the plurality of pins of the lid, and wherein the lid mounting assembly is configured to so as to enable selective removal of the lid from the base, wherein the lid mounting assemblies comprise at least one C-shaped receiver configured to receive the pins of the lid.

* * * * *